US005901592A

United States Patent [19]

Okamura

[11] Patent Number: 5,901,592

[45] Date of Patent: May 11, 1999

[54] ROLLING METHOD OF WIDE FLANGE BEAM IN UNIVERSAL ROLLING MILL

[75] Inventor: Isamu Okamura, Kurashiki, Japan

[73] Assignee: Kawasaki Steel Corporation, Kobe, Japan

[21] Appl. No.: 09/028,476

[22] Filed: Feb. 24, 1998

[30] Foreign Application Priority Data

Feb. 25, 1997 [JP] Japan ..... 9-040244

[51] Int. Cl.[6] ..... B21B 37/58

[52] U.S. Cl. ..... 72/10.4; 72/14.4; 72/225

[58] Field of Search ..... 72/10.1, 10.4, 72/13.1, 13.2, 13.4, 14.1, 14.4, 225

[56] References Cited

U.S. PATENT DOCUMENTS

| | | | |
|---|---|---|---|
| 4,918,964 | 4/1990 | Engel et al. | 72/14.4 |
| 5,375,448 | 12/1994 | Katayama | 72/8 |
| 5,568,032 | 10/1996 | Wakui | 318/632 |

FOREIGN PATENT DOCUMENTS

| | | | |
|---|---|---|---|
| 50-25202 | 6/1985 | Japan | 72/13.11 |
| 60-99422 | 6/1985 | Japan | 72/13.1 |
| A-63-66608 | 3/1988 | Japan . | |

OTHER PUBLICATIONS

"Theory and Practices of Plate and Sheet Rolling", pp. 229–232, edited by the Iron and Steel Institute of Japan.

M. Tanaka et al., "Decoupled Automatic Gauge Control for Universal Rolling Mills," No. 317, (1985), pp. 48–58.

*Primary Examiner*—Joseph J. Hail, III
*Assistant Examiner*—Ed Tolan
*Attorney, Agent, or Firm*—Oliff & Berridge, PLC

[57] ABSTRACT

The method of rolling a wide flange beam results in an improved accuracy of the web thickness and the flange thickness in a universal rolling mill. Rolling a wide flange beam in a universal rolling mill having horizontal rolls and vertical rolls, switching over the positional control gain for each of drives for the horizontal rolls and drives for the vertical rolls by means of measured values of rolling load on the horizontal rolls and the vertical rolls during rolling, or filtering a control amount of the horizontal roll position calculated from a rolling load acting on the horizontal rolls and a control amount of the vertical roll position calculated from a rolling load acting on the vertical rolls to achieve different responses of horizontal roll rolling and vertical roll rolling, results in reducing mutual interference between horizontal roll rolling and vertical roll rolling caused through the rolling material.

6 Claims, 8 Drawing Sheets

ROLLING METHOD OF WIDE FLANGE BEAM IN UNIVERSAL ROLLING MILL

BACKGROUND OF THE INVENTION

1. Field of the Invention

The present invention relates to a method of rolling a wide flange beam by the use of a universal rolling mill comprising horizontal rolls and vertical rolls. More particularly, the present invention relates to a method of rolling, in a universal rolling mill, a wide flange beam excellent in accuracy of a web thickness and a flange thickness by causing a drive of the screw-down for the horizontal rolls and a drive of the screw-down for the vertical rolls to operate independently of each other by means of measured values of rolling load acting on the horizontal rolls and the vertical rolls during rolling, even with an unknown rigidity of the material to be rolled.

2. Description of the Related Art

There has conventionally been well known a technique of controlling the thickness of a flat sheet by causing a change in the rolling roll gap during rolling. As is described in the "Theory and Practices of Plate and Sheet Rolling" edited by the Iron and Steel Institute of Japan, p. 229–231, a basic technique of measuring a rolling load with a load cell or the like, and causing a change in the roll gap in accordance with the following formula, thereby controlling the sheet thickness is known as the gauge meter AGC (Automatic Gauge Control):

$$\Delta S=-\alpha\Delta F/K_m \tag{1}$$

where, ΔS is an amount of change in the roll gap, ΔF is a change in load from a lock-on load, $K_m$ is a mill rigidity, and α is a correction coefficient known as a tuning rate.

Operation of the roll gap is performed by the use of an electrically driven screw-down motor or a hydraulic cylinder, and it is more often the common practice to use a hydraulic cylinder because of a better response and benefits in mechanical structure.

By the use of the foregoing gauge meter AGC, a variation in flat sheet thickness Δh can be calculated by the following formula:

$$\begin{aligned}\Delta h &= \Delta F / K_m + \Delta S \\ &= (1-\alpha)\Delta F / K_m\end{aligned} \tag{2}$$

Since the load ΔF varies also with a variation in thickness, it can be expressed by the following formula:

$$\Delta F=Q\Delta h+\Delta F_{dis} \tag{3}$$

where, Q is rigidity (plasticity constant) of the flat sheet, and $\Delta F_{dis}$ is a load disturbance caused by a variation in thickness on the entry side or a change in rolling temperature. From the foregoing formulae (2) and (3), the variation in flat sheet thickness Δh can be expressed eventually by the following formula:

$$\Delta h=\{(1-\alpha)/(K_m+(1-\alpha)Q\}\Delta F_{dis} \tag{4}$$

where, it is known that the tuning rate α, generally taking a value near 1, an error, if any, in flat sheet thickness Δh can be minimized even upon occurrence of a load disturbance $\Delta F_{dis}$.

While the formulae (1) to (4) have shown stationary properties of gauge meter AGC, a transient response depends upon dynamic properties of the drive.

Now, the features of the gauge meter AGC will be briefly described below. As is described in the aforesaid reference, the gauge meter AGC has transient dynamic properties varying with rigidity (plasticity constant) of the material. However because the tuning rate generally takes a value near 1, the stationary properties do not depend upon rigidity Q or deformation property of the material, as shown in the formula (4). This control is achievable by only knowing the easily predictable mill rigidity $K_m$ even when rigidity Q of the material difficult to predict in general is unknown, as indicated by the formula (1). This is a feature of the gauge meter AGC.

The difficulty in predicting a material rigidity is caused by plastic deformation of the material. Because plastic deformation largely depends upon material quality and temperature, it is difficult to predict this phenomenon. Since a mill complies with elastic deformation, on the other hand, prediction of deformation thereof is easy.

The foregoing gauge meter AGC is widely applied to flat rolling mills. Because of the difficulty in mechanical structure, however, there are available only a few cases of application of the gauge meter AGC to a universal rolling mill for rolling a wide flange beam having a web portion 12 and flange portions 14 as shown in FIG. 6. However, in accordance with the same technique as that of a flat rolling mill, it suffices to conduct rolling as follows:

$$\Delta S_h=-\alpha\Delta F_w/K_{mh} \tag{5}$$

$$\Delta S_v=-\alpha\Delta F_f/K_{mv} \tag{6}$$

where, h is a horizontal roll, v is a vertical roll, $\Delta F_w$ is a rolling load of the web portion 12 and $\Delta F_f$ is a rolling load of the flange portion 14.

It is estimated, as in the case of flat rolling, that this control permits reduction of errors in web and flange thickness.

As described above, application of the gauge meter AGC to a universal rolling mill can easily be conceived. An important difference from flat rolling is however that the web portion 12 and the flange portions 14 in a wide flange beam 10 are connected, and rolling of the web portion 12 and the flange portions 14 mutually exerts an effect. For example, when the vertical roll gap is tightened to reduce the thickness of the flange portions 14, the load acting on the horizontal rolls is known to be reduced. Therefore, independent application of the gauge meter AGC to vertical roll rolling and horizontal roll rolling as described above would result in a serious mutual influence of the web portion and the flange portions, hence causing interference between the vertical rolls and the horizontal rolls and leading to undesirable vibration.

FIG. 5 illustrates a structure of a universal rolling mill 20 in a case where roll screw-down is performed by means of a hydraulic cylinder. In FIG. 5, horizontal rolls 22 reduce from above and below the web portion 12 of a wide flange beam, and vertical rolls 24 reduce from right and left the flange portions 14 of the side flange beam.

The horizontal rolls 22 are provided, for example, with hydraulic cylinders 26 and 28 for the upper horizontal roll for screwing down at right and left ends of the upper horizontal roll shaft, and hydraulic cylinders 30 and 32 for the lower horizontal roll are provided for a similar purpose for the lower horizontal roll 22. The vertical rolls 24 are similarly provided, for example, with hydraulic cylinders 34 and 36 for the left vertical roll for screwing down the left vertical roll from front and back thereof, and hydraulic cylinders 38 and 40 for the right vertical roll for screwing down similarly the right vertical roll from front and back thereof. These hydraulic cylinders are arranged above and below, and at right and left because the entire universal mill must form a point-symmetry for rolling a wide flange beam.

In order to apply the gauge meter AGC, it is necessary to measure the load during rolling. A load cell is provided for each drive for this purpose. More specifically, as shown in FIG. 5, the right and left hydraulic cylinders 26 and 28 for the upper horizontal roll are provided with load cells 42 and 44 for the upper horizontal roll, respectively, and the right and left hydraulic cylinders 30 and 32 for the lower horizontal roll are provided with load cells 46 and 48 for the lower horizontal roll, respectively. The front and rear hydraulic cylinders 34 and 36 for the left vertical roll are provided with load cells 50 and 52 for the left vertical roll, respectively, and the front and rear hydraulic cylinders 38 and 40 for the right vertical roll are provided with load cells 54 and 56 for the right vertical roll, respectively.

FIG. 7 illustrates a common control configuration of the gauge meter AGC based on hydraulic cylinder screw-down popularly applied in flat plate, cold or hot rolling. In FIG. 7, 60 is a load cell, showing a load F provided as an output. The portion enclosed by dotted lines represents a controller or arithmetic unit 68. The portion within the dotted lines shows a computing logic in the arithmetic unit. The arrows represent the flow of signals, and the symbol on the arrow, the value of signal. The symbol +/− on or to the left of the arrow means addition/subtraction of the value of signal. The squares within the dotted lines means that an input signal from the left is multiplied by a parameter shown by a signal in the square and a resultant signal is issued as an output. A servo valve 62 is adjusted by means of a final output signal from the arithmetic unit 68 to move a cylinder 64 through a hydraulic piping 66. A cylinder positional signal $S_{FBK}$ is fed back to the arithmetic unit 68. Among the signals within the dotted lines, ΔF represents a deviation from the lock-on load $F_o$, $K_m$ is a mill constant, α is a tuning rate, ΔS is an AGC control amount, $S_o$ is a (hydraulic) cylinder positioning value before biting, $S_{FBK}$ is a measured value of cylinder position, and G is a cylinder position control gain. The positioning time must be adjusted so that the cylinder positioning time before biting does not become excessively longer, since the positioning time depends upon this control gain G. The control gain G is therefore usually adjusted so as to ensure execution of cylinder position setting at the highest possible speed, while observing a response of the hydraulic cylinder 64 and the like.

FIG. 8 illustrates a case of independent application of the flat rolling gauge meter AGC shown in FIG. 7 to horizontal rolling and vertical rolling on a universal mill 20. The upper portion relative to a one-point chain line corresponds to horizontal rolling, and the lower portion, to vertical rolling. In this thickness controller, the gauge meter AGC apparatus 70 based on screw-down by the hydraulic cylinder of the horizontal roll and the gauge meter AGC apparatus 72 based on screw-down by the hydraulic cylinder of the vertical roll are independent of each other. In FIG. 8, $F_h$ is a load acting on the horizontal roll 22, $\Delta F_h$ is a deviation from the horizontal roll lock-on load $F_{h0}$, $K_{hm}$ is a mill constant in the vertical direction of the universal mill 20, α is a tuning rate, $\Delta S_h$ is a horizontal roll AGC control amount, $S_{h0}$ is a set value of the horizontal roll cylinder position before biting, and $G_{hi}$ (i=1 to 4) is a positional control gain for each cylinder. Similarly, variables such as $F_v$, $\Delta F_v$, $F_{v0}$, $\Delta S_v$ and $G_{vi}$ (i=1 to 4) are defined also for the vertical roll 24. $K_{vm}$ is a mill constant in the transverse direction of the universal mill 20. Usually, the cylinder positional control gains $G_{hi}$ and $G_{vi}$ must be adjusted so as to ensure rapid positional setting before biting.

FIG. 9 illustrates the result of control in a case of application of the controller shown in FIG. 8. As is clear from FIG. 9, as a result of mutual influence of the web and the flanges of a wide flange beam occurring during rolling, a behavior suggesting vibration appears immediately upon start of control, resulting in a large thickness deviation.

To solve this problem, there is proposed a method of eliminating interference taking account of the mutual influence when controlling the flange portions and the web portion, as described in the "Non-Interference Thickness Control of Large-Scale Rolling Mill, Iron and Steel-Making Research, No. 317 (1985), p. 48–58" and Japanese Examined Patent Publication No. 63-66608. More specifically, by the use of a linearized rolling load model describing the mutual influence of the web portion and the flange portions during rolling, the proposed method comprises the steps of operating drives so as to prevent mutual interference, thereby eliminating the interference phenomenon.

In such a method of control for eliminating interference between the horizontal rolls and the vertical rolls by means of a rolling load model, it is necessary to provide a model strictly describing the rolling phenomenon, and the following problems have been posed.

(1) In the wide flange beam rolling presenting a three-dimensional deformation property, it is very difficult to prepare a model strictly describing the rolling phenomenon because of the difficulty in applying the well-known rolling theory.

(2) In general, a plastic deformation phenomenon is a non-linear model, and it is difficult to completely eliminate interference because of this non-linearity.

(3) A driving equipment generally exhibits a high-order response, and it is difficult to ensure elimination of interference with the high-order response also in view.

Even with an unknown rigidity of the material difficult to predict in general, a feature of the flat rolling gauge meter AGC is to permit achievement thereof by knowing only the mill rigidity. However, simple application of the flat rolling gauge meter AGC to a universal mill causes the problem as described above.

SUMMARY OF THE INVENTION

The present invention has therefore an object to permit achievement of control of the web thickness and the flange thickness even with an unknown rigidity of the material also in a universal mill as in the flat rolling gauge meter AGC.

The present invention provides a rolling method of a wide flange beam on a universal rolling mill, when rolling a wide flange beam by the use of a universal mill comprising horizontal rolls and vertical rolls, comprising the step of independently operating drives of the screw-down for the horizontal rolls and drives of the screw-down for the vertical rolls by means of measured values of rolling load acting on the horizontal rolls and the vertical rolls during rolling, thereby controlling the web thickness and the flange thickness of the wide flange beam.

Other features and advantages of the present invention will be apparent from the following detailed description including variations thereof.

DESCRIPTION OF THE PREFERRED EMBODIMENTS

As a result of extensive tests and studies, the present inventors found a method of rolling a wide flange beam excellent in accuracy of the web thickness and the flange thickness.

When introducing the conventional flat rolling gauge meter AGC into a universal mill, mutual interface occurs in the horizontal roll rolling and the vertical roll rolling because the plurality of drives have responses of substantially the same order and mutually exert influence to substantially the same extent. An adverse effect caused by the mutual influence can be alleviated by excluding this condition. The present invention was developed on the basis of such findings. The invention provides a method of rolling for controlling the web thickness and the flange thickness of a wide flange beam by independently operating drives of the screw-down for horizontal rolls and drives of the screw-down for vertical rolls by means of measured values of rolling load acting on the horizontal rolls and the vertical rolls during rolling.

Now, embodiments of the invention will be described in detail below with reference to the drawings.

Figure 1:
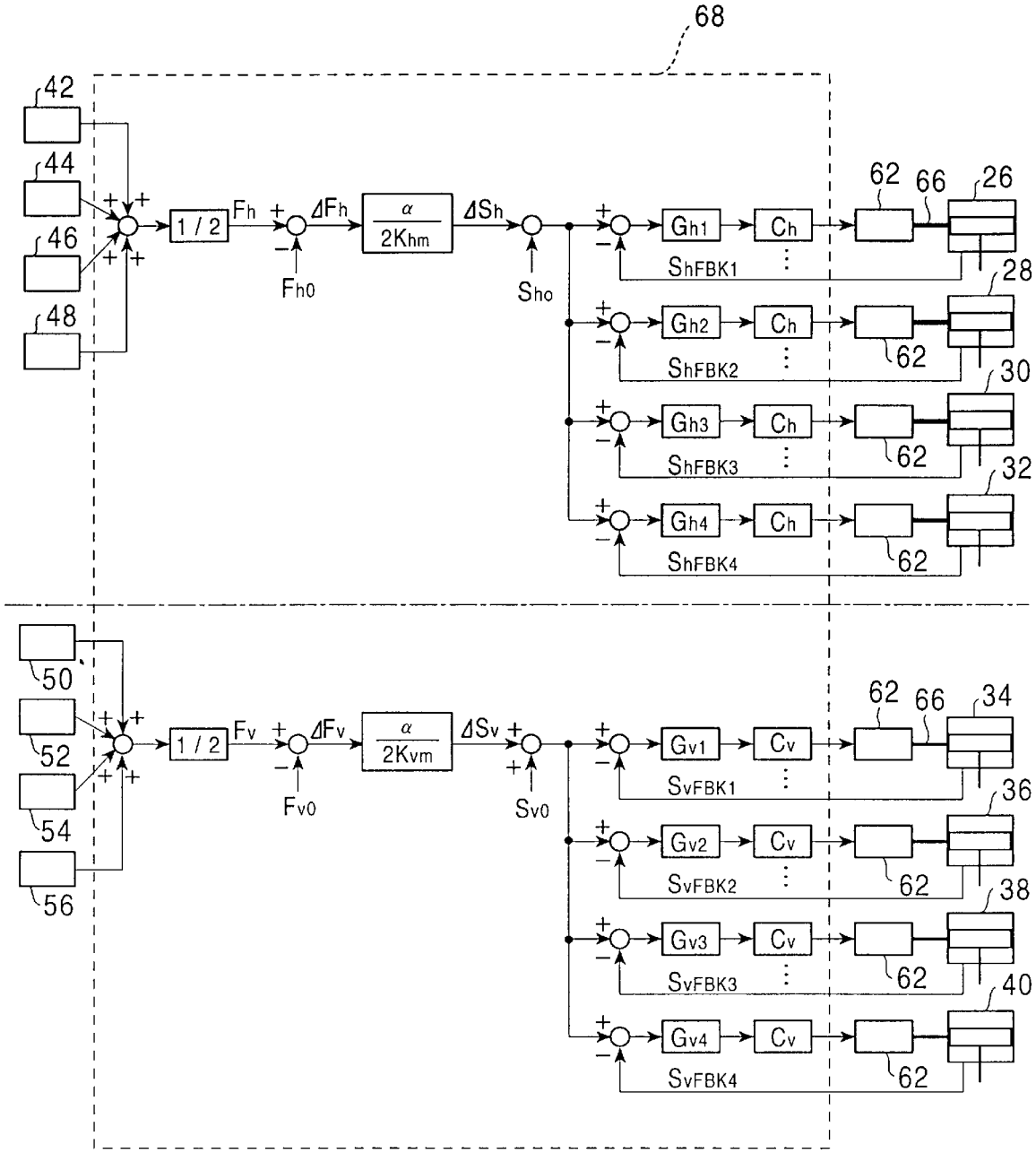
FIG. 1 is a block diagram illustrating a controller of a first embodiment of the present invention.

FIG. 1 is a block diagram illustrating an operation within controller 68 of a first embodiment of the invention. This covers a case where, taking account of a positional control gain, the method of the invention is independently applied for horizontal rolling and vertical rolling in the thickness control method of flat rolling. The upper portion relative to the one-point chain line corresponds to horizontal rolling, and the lower portion, to vertical rolling.

In FIG. 1, $C_h$ and $C_v$ represent coefficients for multiplication of horizontal or vertical roll positional control gains $G_{hi}$ and $G_{vi}$, which are not changed, i.e., $C_h=C_v=1.0$, when the method of the invention is not applied. When applying the method of the invention, these gains are multiplied by prescribed values $C_{h0}$ and $C_{v0}$, respectively. This change in gains permits change in response of the horizontal roll drive of the screw-down and the vertical roll drive of the screw-down. By appropriately changing the response, it is possible to minimize interference between the horizontal roll rolling and the vertical roll rolling caused by mutual influence between the web and the flanges.

Figure 3:
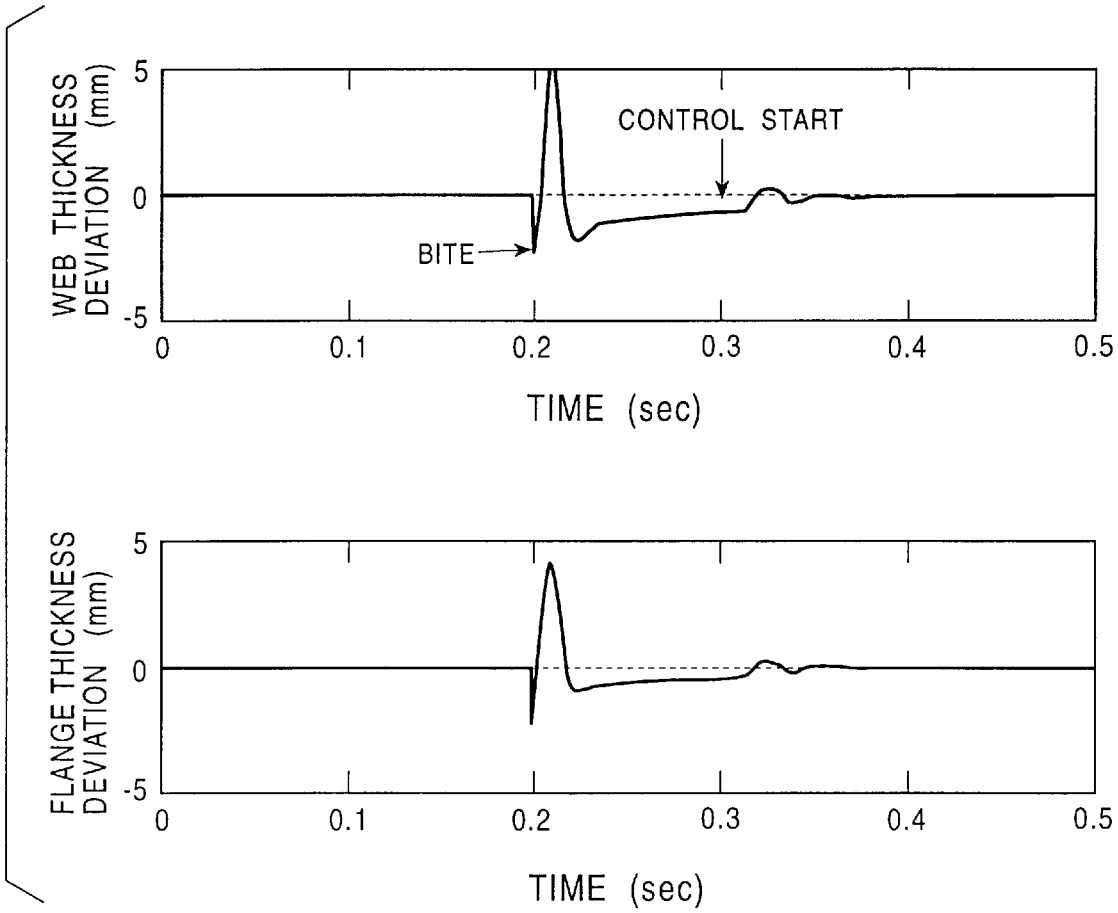
FIG. 3 illustrates the result of control in a use of the controller shown in FIG. 1.
Figure 9:
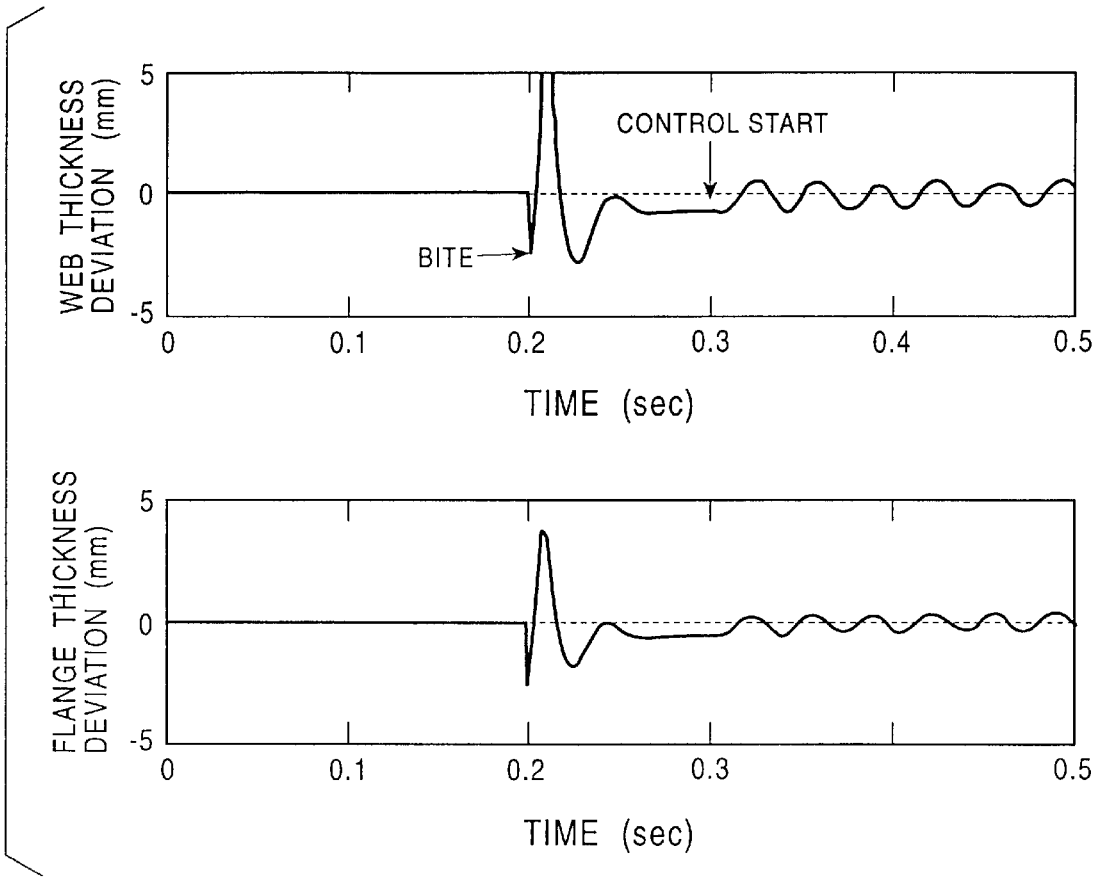
FIG. 9 illustrates the result of control in a use of the controller shown in FIG. 8.

FIG. 3 illustrates the result of control in a use of the controller of the first embodiment shown in FIG. 1 under the same rolling conditions as in FIG. 9. Switching of gains comprised, as a result of examination of various rolling conditions, changing to $C_{h0}=0.8$ for the horizontal rolls, and to $C_{v0}=1.0$ for the vertical rolls, when executing the invention provides a reduction in vibration. Other appropriate values may also be used. As is clear from the comparison of FIGS. 3 and 9, the vibrational behavior caused by the interference between horizontal roll rolling and vertical roll rolling is reduced, thus permitting confirmation of a remarkable effect.

In this first embodiment, the value of control gain was switched over by changing the value of the multiplying coefficient $C_h$ or $C_v$ of the horizontal roll or vertical roll positional control gain. The method of switching over the control gain is not however limited to this, but the value of control gain $G_{hi}$ or $G_{vi}$ may directly be changed.

In general, a larger positional control gain results in a more rapid response of the drives, and a smaller gain leads to a slower response thereof. By the utilization of this feature, in the first embodiment, the influence of interference is alleviated and the interference caused by the mutual interference between the web portion and the flange portions is minimized by achieving responses of the drives of the screw-down for the horizontal rolls and the drives of the screw-down for the vertical rolls, of which one is more rapid, and the other is slower.

Now, the control mechanism of a second embodiment of the invention will be described below with reference to FIG. 2.

Figure 2:
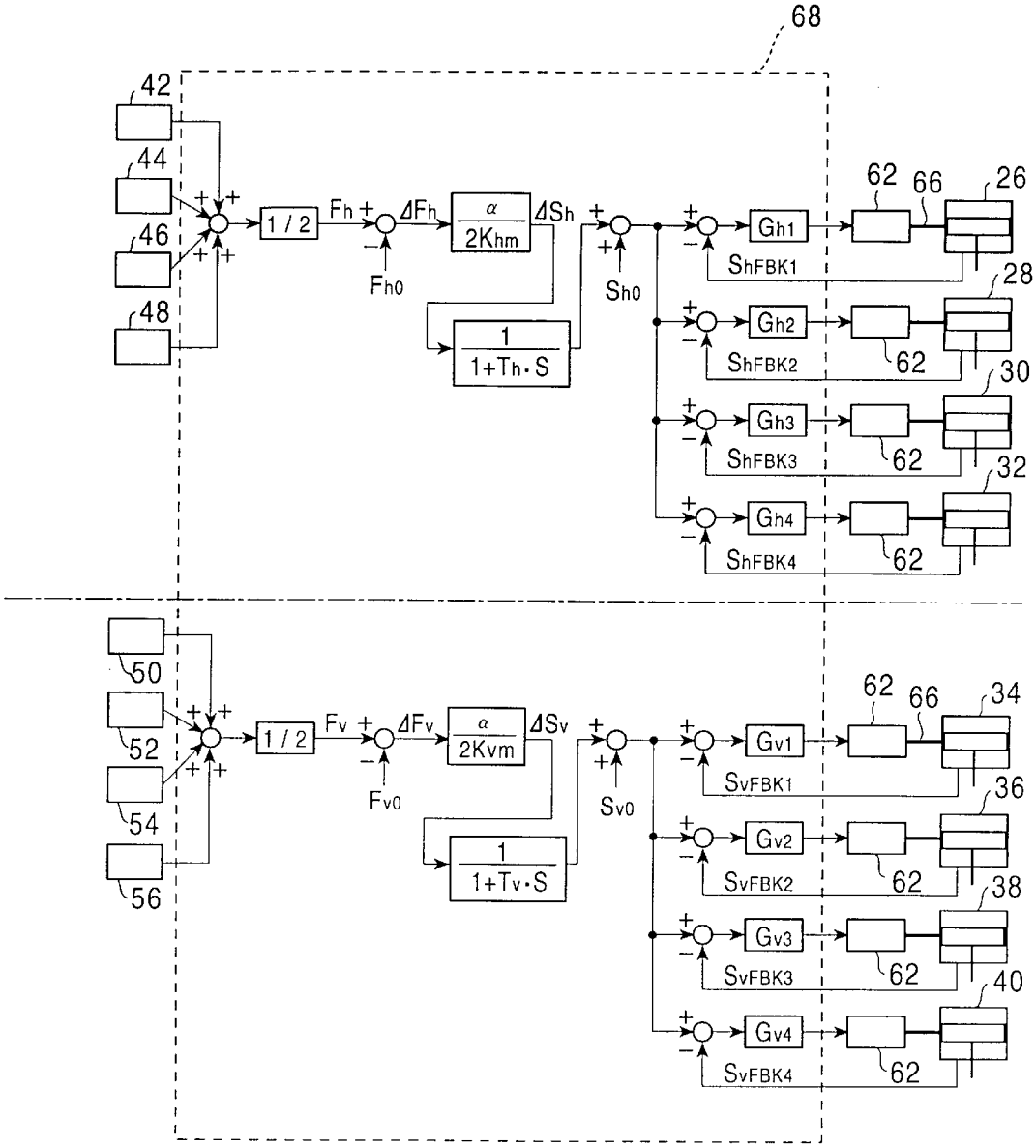
FIG. 2 is a block diagram illustrating a controller of a second embodiment of the invention.

FIG. 2 is a block diagram illustrating the controller of the second embodiment of the invention. The second embodiment covers a case where, taking account of filtering of the positional control amount, the invention is directly applied for horizontal rolling and vertical rolling in the flat rolling thickness control method. The upper portion relative to the one-point chain line corresponds to horizontal rolling, and the lower portion, to vertical rolling.

In FIG. 2, $T_h$ and $T_v$ represent time constants of (primary) filtering imparted to the horizontal rolls or vertical roll positional control amount. The filtering $1/(1+T_h \cdot S)$ and $1/(1+T_v \cdot S)$ represents a first order transfer function. By means of these time constants $T_h$ and $T_v$, it is possible to change responses of the horizontal roll positional control and the vertical roll positional control. By appropriately changing responses, interference between horizontal roll rolling and vertical roll rolling caused by the mutual influence between the web and the flanges can be minimized.

Figure 4:
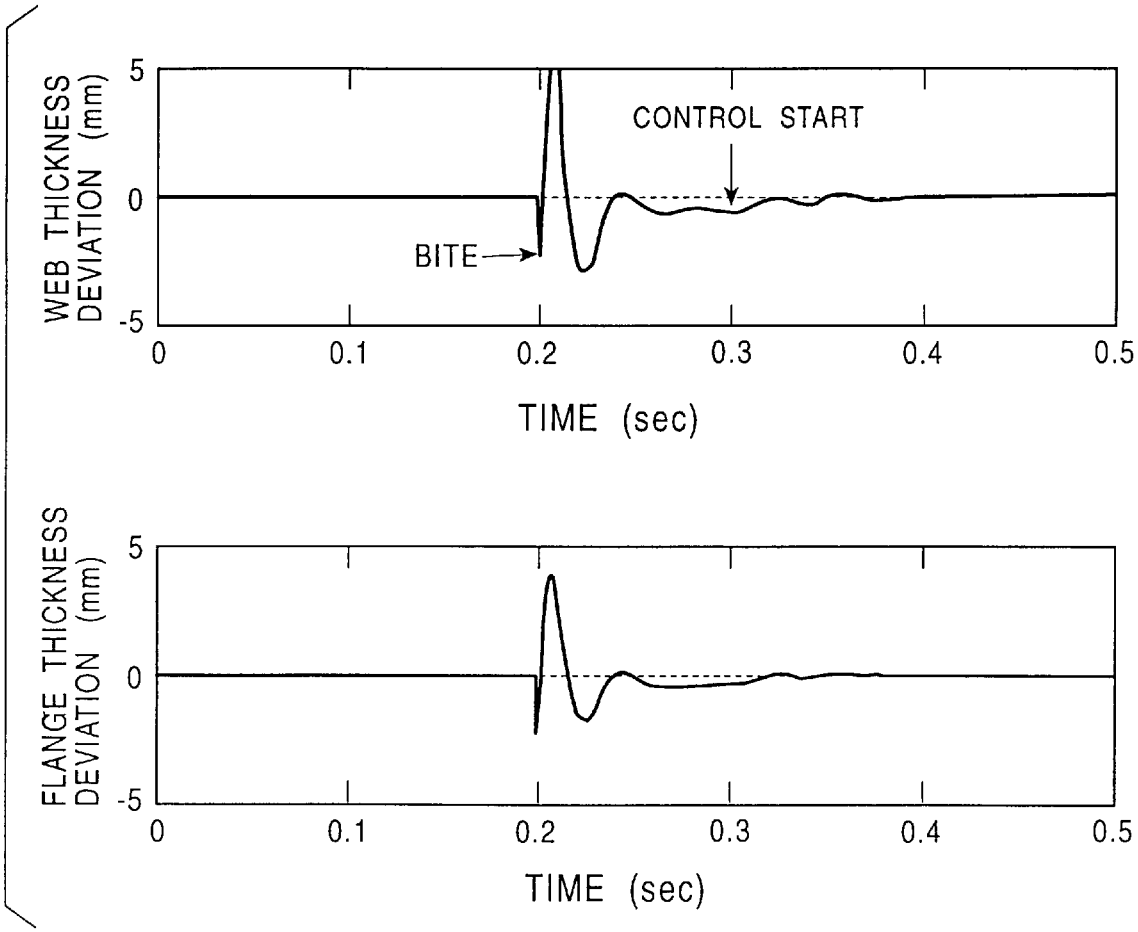
FIG. 4 illustrates the result of control in a use of the controller shown in FIG. 2.
Figure 5:
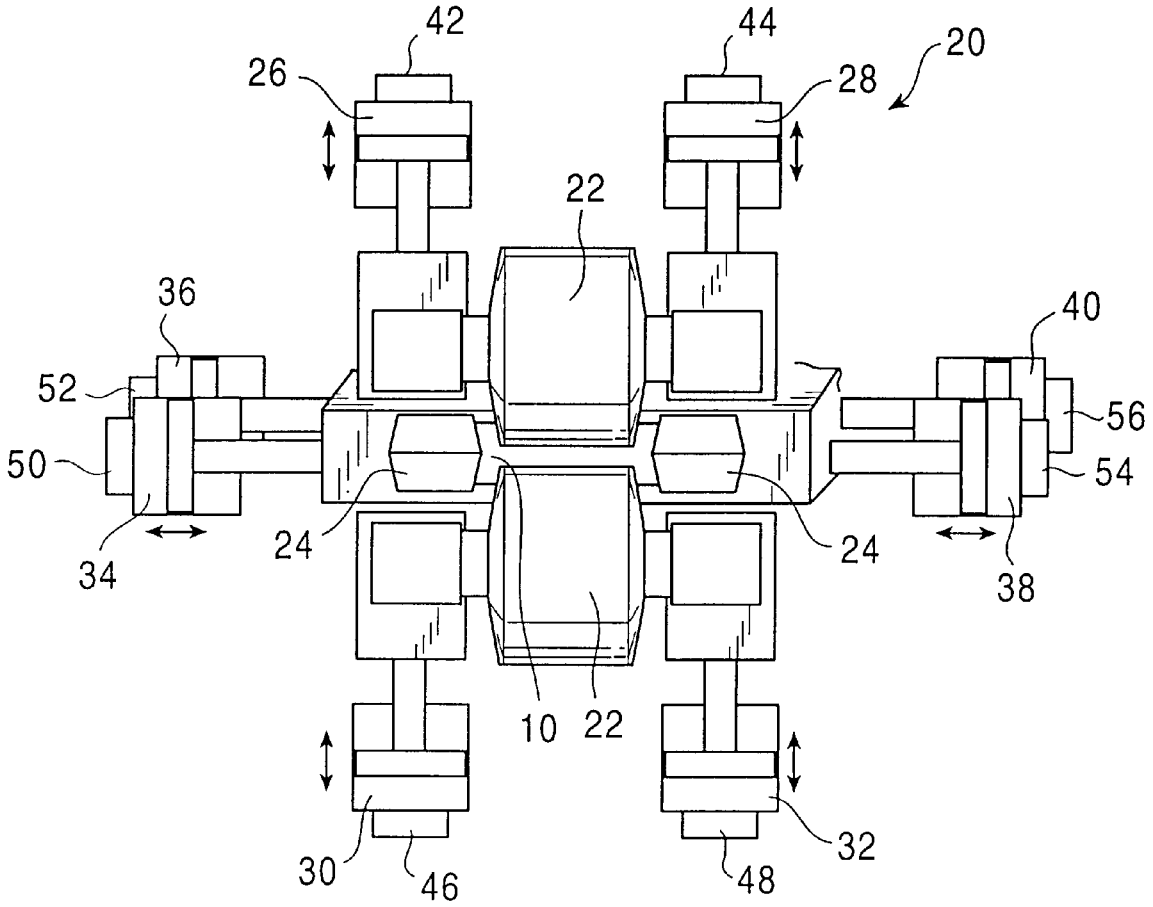
FIG. 5 is a sectional view illustrating the structure of a universal rolling mill.
Figure 6:
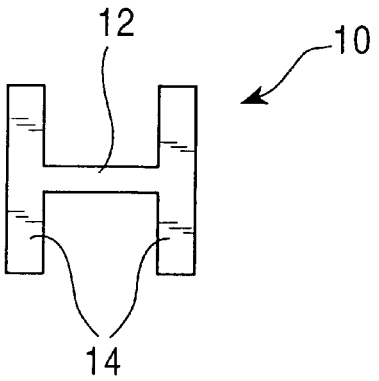
FIG. 6 is a sectional view illustrating the shape of a wide flange beam.
Figure 7:
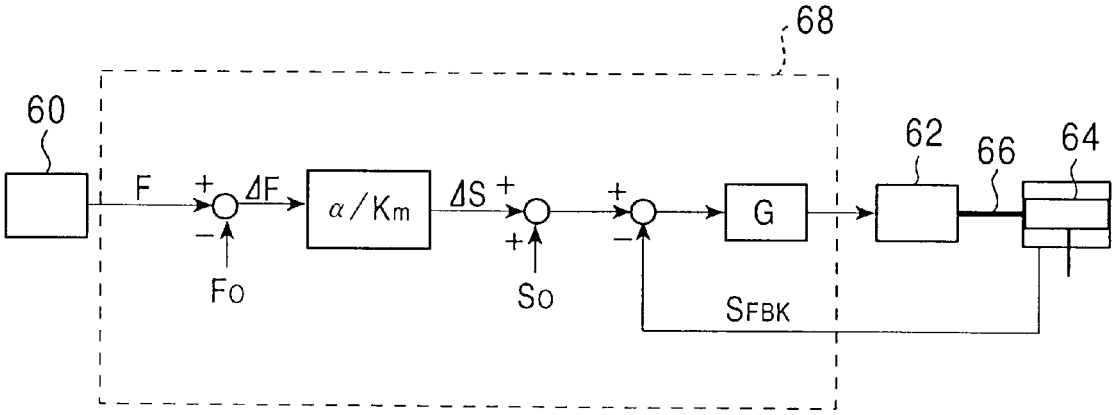
FIG. 7 is a block diagram illustrating a gauge meter AGC controller commonly used for flat rolling.
Figure 8:
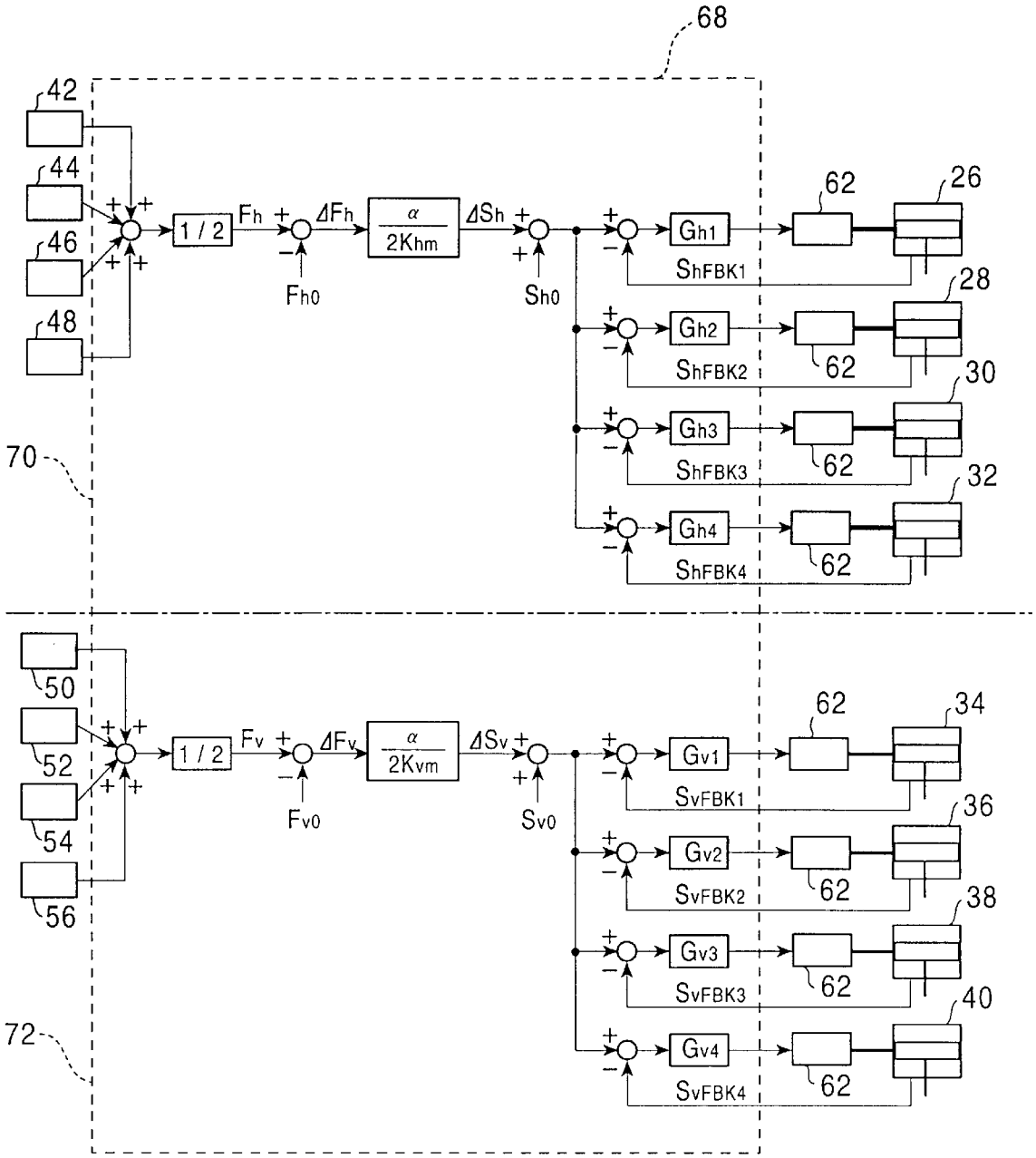
FIG. 8 is a block diagram illustrating a case where the flat rolling gauge meter AGC controller shown in FIG. 7 is applied for horizontal rolling and vertical rolling on the universal mill shown in FIG. 5.

FIG. 4 illustrates the result of control in a use of the controller of the second embodiment shown in FIG. 2 under the same rolling conditions as in FIG. 9. In the controller of the second embodiment, $T_h=100$ msec and $T_v=0$ (no filtering) were adopted as filtering time constants from various rolling conditions. These values were determined by experimentation but other values may be used as well. As is evident from the comparison of FIGS. 4 and 9, vibrational behavior caused by the interference between horizontal roll rolling and vertical roll rolling, thus permitting confirmation of a remarkable effect.

In the second embodiment, the interference caused by the mutual influence of the web portion and the flange portions is minimized by alleviating the effect of interference by adopting responses of the horizontal roll positional control and the vertical roll positional control, of which one is more rapid and the other is slower.

In wide flange beam rolling, the flange thickness is in many cases required to have a higher accuracy than the web thickness. In this case, it suffices to use a more rapid response of vertical roll positional control, and a slightly slower response of horizontal roll positional control.

While, in this second embodiment, $\Delta S_h$ and $\Delta S_v$ are filtered, the step is not limited to this, but any manner may be applied so far as it permits a change in control response.

Further, in the foregoing embodiments, roll screw-down has been accomplished by the use of hydraulic cylinders. The manner of screw-down is not limited to this, but it is needless to mention that the invention is similarly applicable even in roll screw-down by the use of an electrically driven motor as a drive.

ADVANTAGES

According to the invention, it is possible to accomplish thickness control, even with an unknown rigidity of the material, as in the flat rolling gauge meter AGC, in a universal rolling mill, by reducing interference caused by a mutual influence between the web portion and the flange portions. This technique permits manufacture of a wide flange beam excellent in the accuracy of the web thickness and the flange thickness.

What is claimed is:

1. A method of rolling a material to form a wide flange beam having a web thickness and a flange thickness in a universal rolling mill, the universal rolling mill having horizontal rolls and vertical rolls, comprising the steps of:

independently operating a drive of the screw-down for the horizontal rolls and a drive of the screw-down for the vertical rolls based on measured values of a rolling load on the horizontal rolls and the vertical rolls, respectively, during rolling; and applying a first positional control gain to the drive of the screw-down for the horizontal rolls and a second positional control gain to the drive of the screw-down for the vertical rolls to control the web thickness and the flange thickness of the wide flange beam so that the web thickness of the wide flange beam has a first control response different from a second control response of the flange thickness of the wide flange beam, and the drive of the screw-down for the horizontal rolls and the drive of the screw-down for the vertical rolls exert substantially no interference on each other.

2. A method of rolling a material to form a wide flange beam in a universal rolling mill according to claim 1, wherein the control response of the flange thickness is made more rapid than the control response of the web thickness, such that the flange thickness has a higher accuracy than the web thickness.

3. A method of rolling a material to form a wide flange beam in a universal rolling mill according to claim 1, wherein the rigidity of the material is unknown.

4. A method of rolling a material to form a wide flange beam having a web thickness and a flange thickness in a universal rolling mill, the universal rolling mill having horizontal rolls and vertical rolls, comprising the steps of:

independently operating a drive of the screw-down for the horizontal rolls and a drive of the screw-down for the vertical rolls based on measured values of the rolling load on the horizontal rolls and the vertical rolls, respectively, during rolling; and individually filtering a first positional control amount of the horizontal rolls calculated from a rolling load acting on the horizontal rolls and a second positional control amount of the vertical rolls calculated from a rolling load acting on the vertical rolls;

wherein the drive of the screw-down for the horizontal rolls and the drive of the screw-down for the vertical rolls exert substantially no interference on each other.

5. A method of rolling a material to form a wide flange beam in a universal rolling mill according to claim 4, wherein the control response of the flange thickness is made more rapid than the control response of the web thickness, such that the flange thickness has a higher accuracy than the web thickness.

6. A method of rolling a material to form a wide flange beam in a universal rolling mill according to claim 4, wherein the rigidity of the material is unknown.

* * * * *